US009633777B2

(12) United States Patent
Lacerda

(10) Patent No.: US 9,633,777 B2
(45) Date of Patent: Apr. 25, 2017

(54) HIGH IMPEDANCE AIR CORE REACTOR

(75) Inventor: Daniel Oliveira Lacerda, Itajuba MG (BR)

(73) Assignee: ALSTOM TECHNOLOGY LTD., Baden (CH)

( * ) Notice: Subject to any disclaimer, the term of this patent is extended or adjusted under 35 U.S.C. 154(b) by 0 days.

(21) Appl. No.: 14/364,797

(22) PCT Filed: Dec. 20, 2011

(86) PCT No.: PCT/EP2011/073457

§ 371 (c)(1),
(2), (4) Date: Jun. 12, 2014

(87) PCT Pub. No.: WO2013/091683

PCT Pub. Date: Jun. 27, 2013

(65) Prior Publication Data

US 2014/0327509 A1 Nov. 6, 2014

(51) Int. Cl.
*H01F 27/28* (2006.01)
*H01F 37/00* (2006.01)
(Continued)

(52) U.S. Cl.
CPC ..... *H01F 27/2871* (2013.01); *H01F 37/005* (2013.01); *H01F 41/066* (2016.01); *H01F 2005/022* (2013.01)

(58) Field of Classification Search
CPC .. H01F 27/027; H01F 27/2823; H01F 27/306; H01F 27/303; H01F 6/06; H01F 27/245
(Continued)

(56) References Cited

U.S. PATENT DOCUMENTS 1,813,994 A * 7/1931 George ..... 336/185
2,735,075 A * 2/1956 Thomason ..... 336/60
(Continued)

FOREIGN PATENT DOCUMENTS

GB 177 898 A 4/1922
GB 640 500 A 7/1950
(Continued)

OTHER PUBLICATIONS

International Search Report issued in Application No. PCT/EP2011/073457 dated Sep. 12, 2012.
(Continued)

*Primary Examiner* — Tsz Chan
(74) *Attorney, Agent, or Firm* — Pearne & Gordon, LLP

(57) ABSTRACT

Air core reactor includes a coil connected between first and second terminals. The coil is made of a succession of bundles of conductor (B1, B2, B3, . . . , BN) connected in series along an axis between the first terminal and the second terminal. Each bundle is made of one wire wound around the axis to form a multi-layer winding having a cross-section of N winding layers in a direction perpendicular to the axis, from a winding layer of rank 1 which is the closest to the axis to a winding layer of rank N which is the furthest from the axis. Each perpendicular winding layer includes several winding layers in the direction of the axis. The number of axial winding of the perpendicular winding layer of rank j (j=2, . . . , N) is equal or less than the number of axial winding layers of the perpendicular winding layer of rank j−1.

8 Claims, 9 Drawing Sheets

(51) Int. Cl.
*H01F 41/066* (2016.01)
*H01F 5/02* (2006.01)

(58) Field of Classification Search
USPC ..... 336/65, 180, 185, 199, 225, 234
See application file for complete search history.

(56) References Cited

U.S. PATENT DOCUMENTS

| | | | | | |
|---|---|---|---|---|---|
| 3,173,112 | A | * | 3/1965 | Welch | 336/12 |
| 3,602,814 | A | * | 8/1971 | Quirk | 324/137 |
| 4,326,181 | A | * | 4/1982 | Allen | H01F 27/2823 174/DIG. 25 |
| 4,471,337 | A | * | 9/1984 | Mausz et al. | 336/186 |
| 4,477,792 | A | | 10/1984 | Putman | |
| 4,554,523 | A | * | 11/1985 | Miki et al. | 336/70 |
| 2009/0174518 | A1 | * | 7/2009 | Chang | 336/229 |
| 2012/0092108 | A1 | * | 4/2012 | Prabhakaran et al. | 336/55 |

FOREIGN PATENT DOCUMENTS

| | | | | |
|---|---|---|---|---|
| JP | 53147226 | A | * | 12/1978 |
| JP | 62021205 | A | * | 1/1987 |
| JP | 2004235112 | A | * | 8/2004 |

OTHER PUBLICATIONS

International Preliminary Report on Patentability for PCT/PCT/EP2011/073457 dated Mar. 14, 2014.

* cited by examiner

HIGH IMPEDANCE AIR CORE REACTOR

TECHNICAL FIELD AND PRIOR ART OF THE INVENTION

The invention relates to an electrical inductive device and, more particularly, to an air core reactor. The invention also relates to a process of manufacturing an air core reactor.

It is a further object of the invention to provide an air core reactor capable of providing a high impedance with minimized dimensions and having a plurality of series-connected coils to thereby allow the utilization for high voltage applications.

Air core reactors (ACR) are applied to many different applications in Power Systems requiring inductors (current limiting, harmonic filtering, among others), mainly in the field of reactive compensation.

The construction of power reactors (inductors) with dry-type technology without an iron-core yields a diversity of benefits, such as reduced costs, robustness, construction simplicity, reliability, low maintenance requirements, linearity, etc. Air Core Reactors are the preferable technology for a number of applications in Power Systems, such as:

- SVC (Static Var Compensation) reactors for controlled reactive compensation;
- Shunt reactors for switched reactive compensation;
- Harmonic filtering;
- Smoothing reactors at HVDC systems;
- Neutral grounding reactors;
- Current limiting reactors (including arc-furnace reactors, inrush reactors at shunt capacitor banks, discharge reactors at series capacitor banks, etc.)

In order to improve reliability of power transmission systems, the utilization of single-phase switching (SPS) and auto-reclosing on EHV transmission line is a common practice. However, in some cases, it is necessary to apply special means like neutral grounding reactor (NGR) to improve the conditions for secondary arc extinction for successful auto-reclosing. This kind of reactor is typically a high impedance, high voltage and low current reactor, which results in an equipment with prohibitive dimensions.

Although reaching high inductive power output, the utilization of ACR's as power inductors is limited to relatively low impedance, due to the absence of an iron core. Some applications, such as neutral grounding reactors (NGR) with high impedance/low current, are usually implemented through classical iron-core oil-filled reactors. The utilization of ACR construction principle for high impedance coils results in very large dimensions and costs that overcome the benefits of the dry-type technology. Specially the large dimensions required at substations hinder the utilization of ACR's as high impedance neutral grounding reactors (NGR).

Iron-core oil-filled reactors are sophisticated and expensive equipment, with high cost and many technical issues concerning maintenance, oil treatment, etc. That makes the solution very expensive to this very simple application.

Typically, air core reactors present a series of advantages against oil-filled reactors for this application. Main advantages are:

- Very lower cost (price), typically less than 50% of oil-filled reactors.
- Reduced dimensions and weight.
- Easiness of installation, due to simplicity of construction.
- Environmental friendly, no need for installations to retain oil leakages.
- Almost free of maintenance.

Even though the above mentioned advantages, normal air core reactors presents very large dimensions, which makes it a non-preferred solution for high impedance neutral grounding. A 800Ω/15 A reactor, for example, may result in an external diameter of around 3 m. Typical 2000Ω/10 A reactor exceeds the manufacturing capabilities of ACR facilities, due to the need of very large dimensions.

Air core reactors manufactured with fibreglass encapsulation are dry-type power reactors, where the coils are made of round insulated wires, encapsulated by fiberglass in several concentric winding cylinders, and clamped together by two cross-arms, which provides also the terminal connections. The FIGS. 1A and 1B represent an example of air core reactor according to the prior art. The FIG. 1B is a detailed view of FIG. 1A. The air core reactor comprises six windings W1-W6 parallel connected, thus forming operationally a unique coil with high current capability. The six windings W1-W6 are divided among three encapsulation packs EP1, EP2, EP3 made of fiberglass, each encapsulation pack comprising two windings parallel connected. Two cross-arms A1, A2 constitute the terminals of the air core reactor. One of the two cross-arms (cross-arm A1 on FIG. 1A) is mounted on four insulators I1-I4. The example of prior art air core reactor manufactured with fibreglass encapsulation of FIGS. 1A and 1B comprises six windings and three encapsulation packs. Generally, prior art air core reactors manufactured with fiberglass encapsulation comprise a number of windings varying typically from one to one hundred and a number of encapsulation packs varying from 1 to twenty. A problem of such air core reactors is that there are limited to relatively low impedance due to the absence of an iron core.

The device of the invention does not have such drawbacks. The device of the invention allows the construction of high impedance air core reactors with significant reduction of dimensions and costs, when it comes to limited steady-state current, if comparing to the prior art technology.

DESCRIPTION OF THE INVENTION

Indeed, the invention relates to an air core reactor comprising a coil connected between a first terminal and a second terminal, characterized in that the coil is made of a succession of bundles of conductor connected in series along an axis between the first terminal and the second terminal, each bundle of conductor being made of one wire wound around said axis so as to form a multi-layer winding having a cross-section made of N winding layers in a direction perpendicular to the axis, from a winding layer of rank 1 which is the closest to the axis to a winding layer of rank N which is the furthest from the axis, each winding layer in the direction perpendicular to the axis comprising several winding layers in the direction of the axis, the number of winding layers in the direction of the axis of the winding layer of rank j (j=2, . . . , N) in the direction perpendicular to the axis being equal or less than the number of winding layers in the direction of the axis of the winding layer of rank j−1 in the direction perpendicular to the axis.

According to another feature of the invention, the cross section of each bundle of conductor is in a trapezoidal form, or a rectangular form, or a square form, or a triangular form.

According to another feature of the invention, the wire conductor is encapsulated in an encapsulation pack made of fiberglass.

According to a first embodiment of the invention, the succession of bundles of conductors is made with a same wire.

According to a second embodiment of the invention, each bundle of conductor is made with a different wire and the bundles of conductor are connected in series by means of electrical connections.

The invention also relates to a process of manufacturing an air core reactor comprising a coil connected between a first terminal and a second terminal, characterized in that it comprises at least one step of winding one wire around an axis so as to form a multi-layer winding having a cross-section made of N winding layers in a direction perpendicular to the axis, from a winding layer of rank 1 which is the closest to the axis to a winding layer of rank N which is the furthest from the axis, each winding layer in the direction perpendicular to the axis comprising several winding layers in the direction of the axis, the number of winding layers in the direction of the axis of the winding layer of rank j (j=2, . . . , N) in the direction perpendicular to the axis being equal or less than the number of winding layers in the direction of the axis of the winding layer of rank j−1 in the direction perpendicular to the axis.

According to another feature, the process of the invention comprises at least two steps of winding along the axis, said at least two steps of winding being made continuously with a same wire.

According to another feature, the process of the invention comprises at least two steps of winding, each step of winding being made separately from the other with a different wire and the multi-layer windings obtained from said at least two steps of winding are series-connected along the axis.

The winding system of the invention is feasible to be applied to typical reactors using fiberglass encapsulated design, resulting in much higher inductance, despite the reduced heat dissipation properties which are not necessary to high impedance neutral grounding reactors.

In conventional air core reactors, all winding layers are parallel-connected, resulting in large conductive section, which allows reaching high rated power. The winding system of the invention is based on a series-connected winding, using at least one conductor. The turns are simply wound in accumulated layers which cross-section forms a stable shape in square, rectangular, triangular or trapezoidal form, thus forming a bundle of conductor to be series-connected with a succession of equal or different bundles. The cross-section with a square, rectangular, triangular or trapezoidal form allows keeping the structure stable for winding at common winding machines for air core reactors. The separation of winding in several bundles allows the complete coil to withstand high BIL (BIL for "Basic Impulse Level") to work at high voltage systems.

BRIEF DESCRIPTION OF THE FIGURES

Other characteristics and advantages of the invention will become clearer upon reading a preferred embodiment of the invention made in reference to the attached figures among which.

In all the figures, the same references designate the same elements.

DETAILED DESCRIPTION OF A PREFERRED EMBODIMENT

Figure 1A:
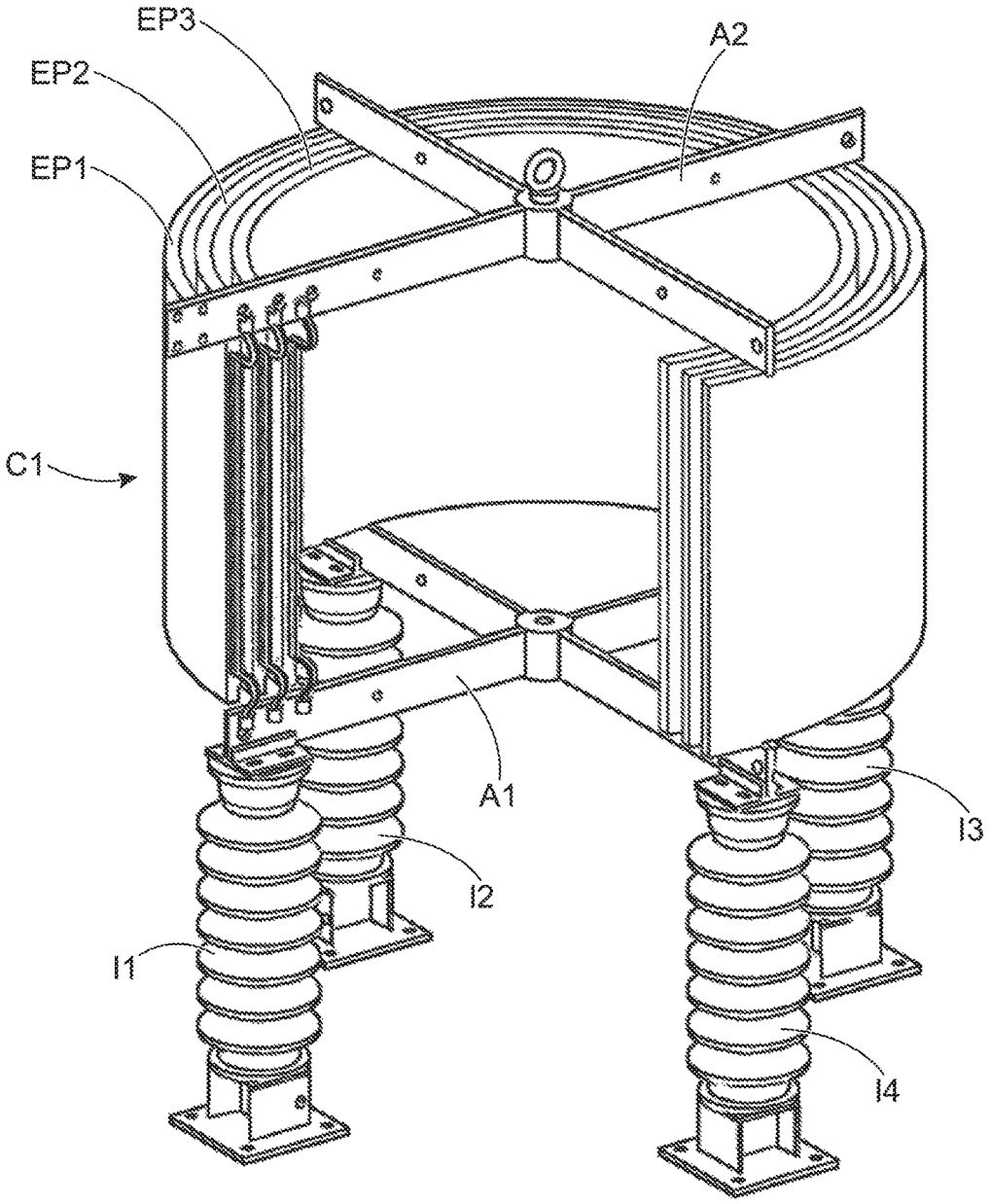
FIG.1A PRIOR ART
FIGS. 1A and 1B show an example of an air core reactor according to the prior art.
Figure 1B:
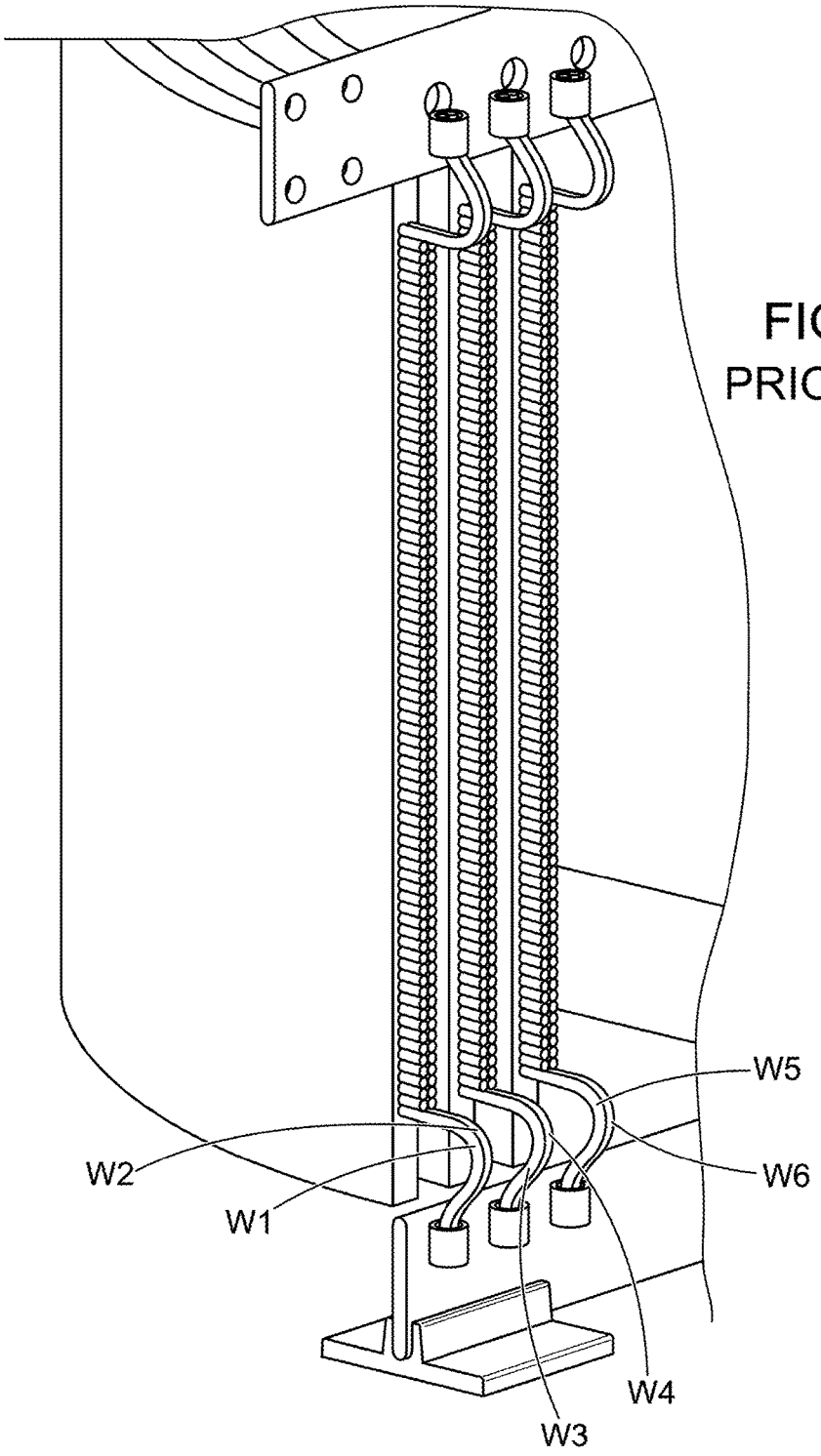
FIG.1B PRIOR ART
Figure 2A:
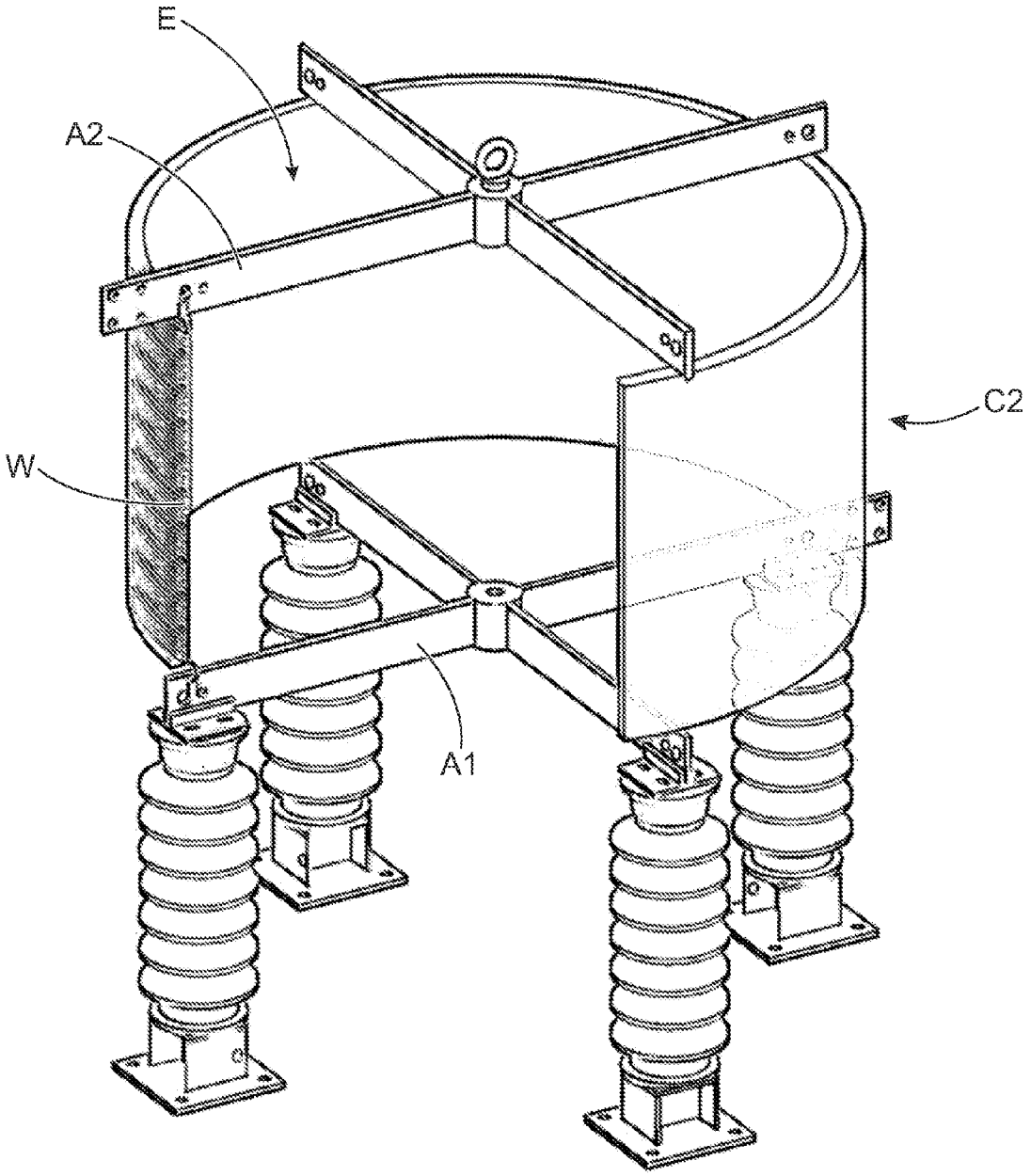
FIGS. 2A, 2B and 2C show an example of a first embodiment of an air core reactor according to the invention.
Figure 2B:
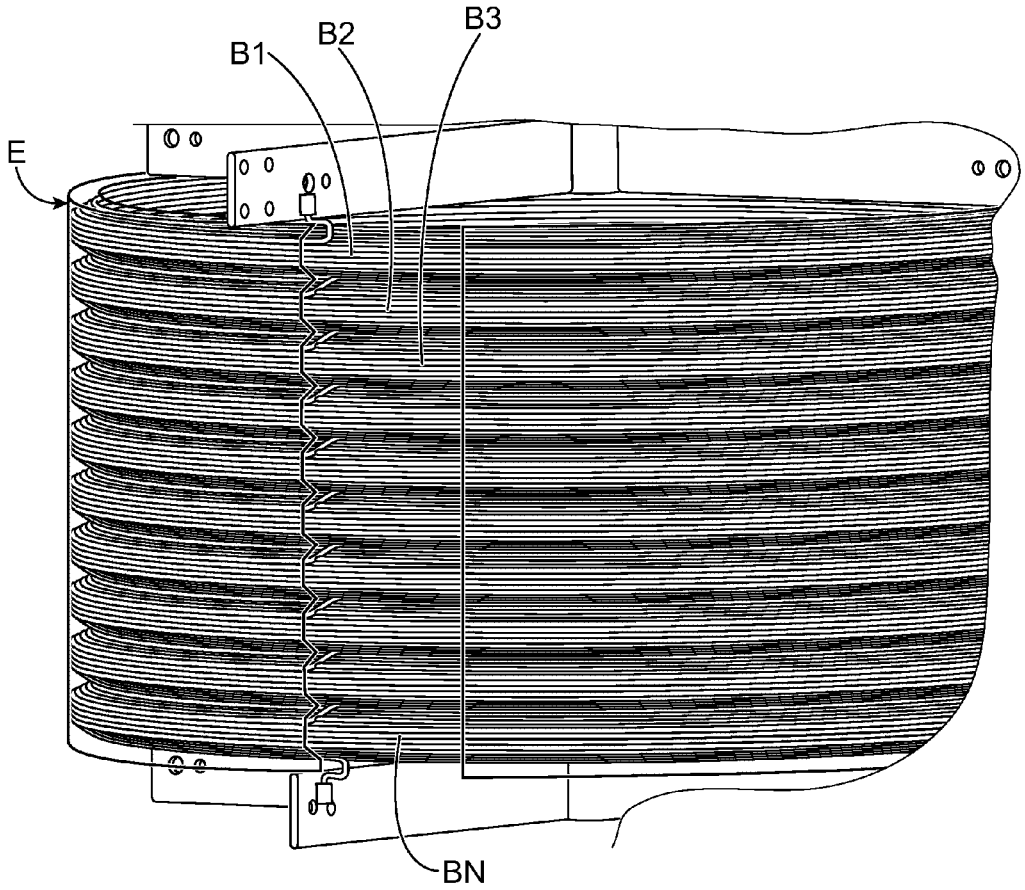
Figure 2C:
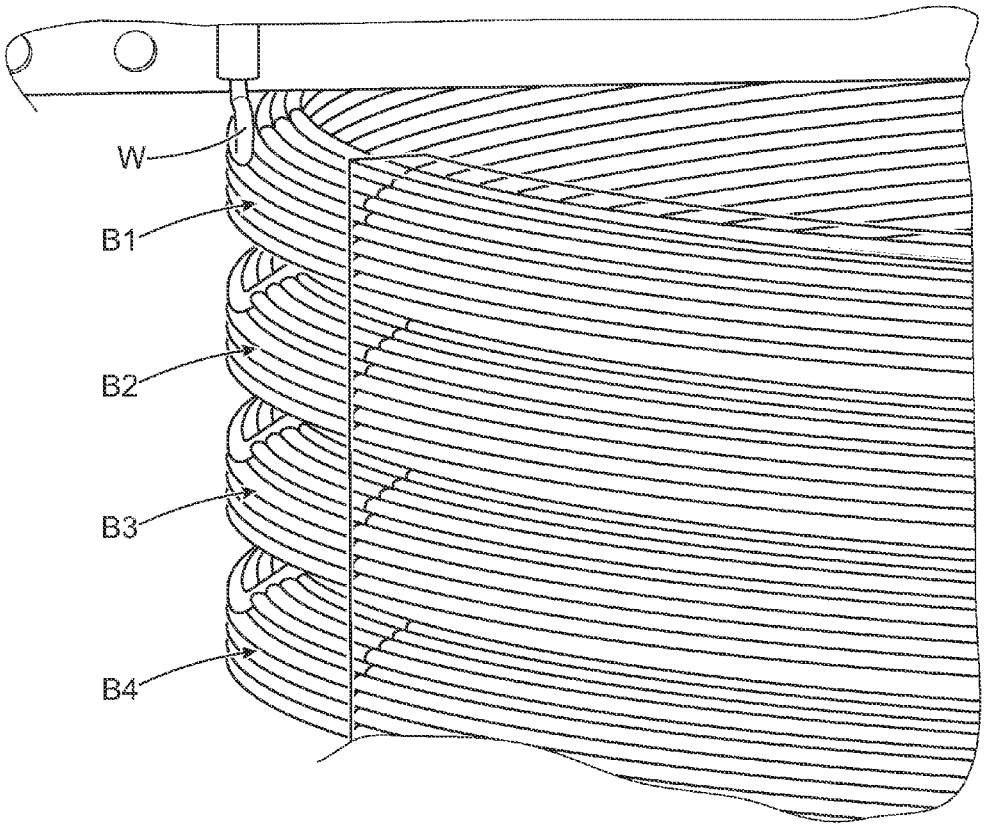

FIG. 2A shows an overall view of an example of air core reactor according to the invention while FIGS. 2B and 2C show two detailed views of FIG. 2A.

The air core of the invention comprises two cross-arms A1, A2, and a coil C2 made of a wire conductor W encapsulated in a fiberglass encapsulation E (see FIGS. 2A and 2B).

According to the first embodiment of the invention, the winding system of the air core reactor uses only one round wire W as conductor. The turns of the round wire conductor W are accumulated to form several bundles of conductor B1, B2, B3, . . . , BN.

Figure 3:
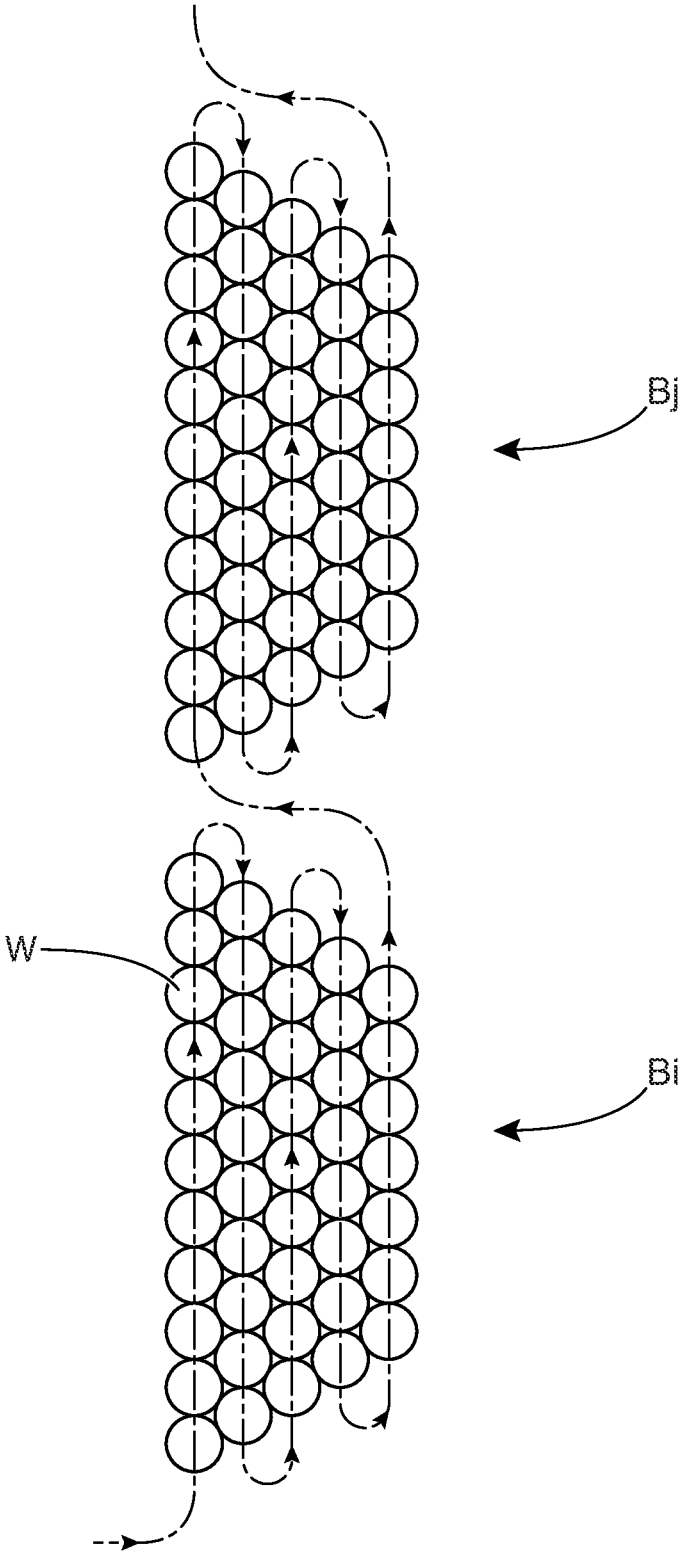
FIG. 3 shows an example of the way a wire conductor is wound to form an air core reactor according to the first embodiment of the invention.
Figure 4:
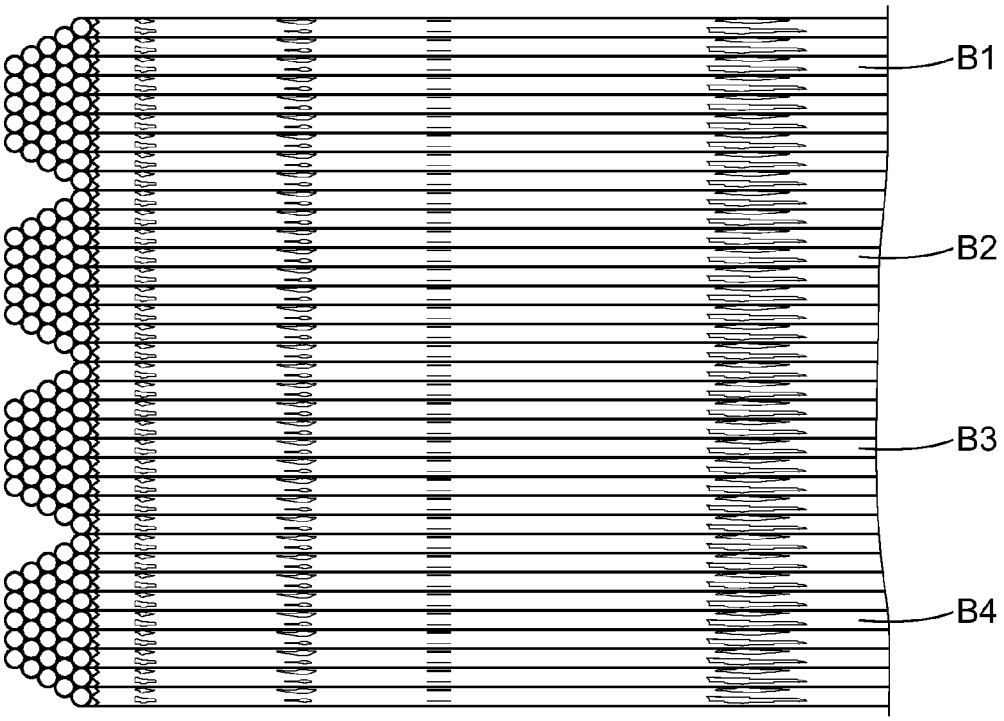
FIG. 4 shows a first example of cross-section of an air core reactor of the invention.
Figure 5:
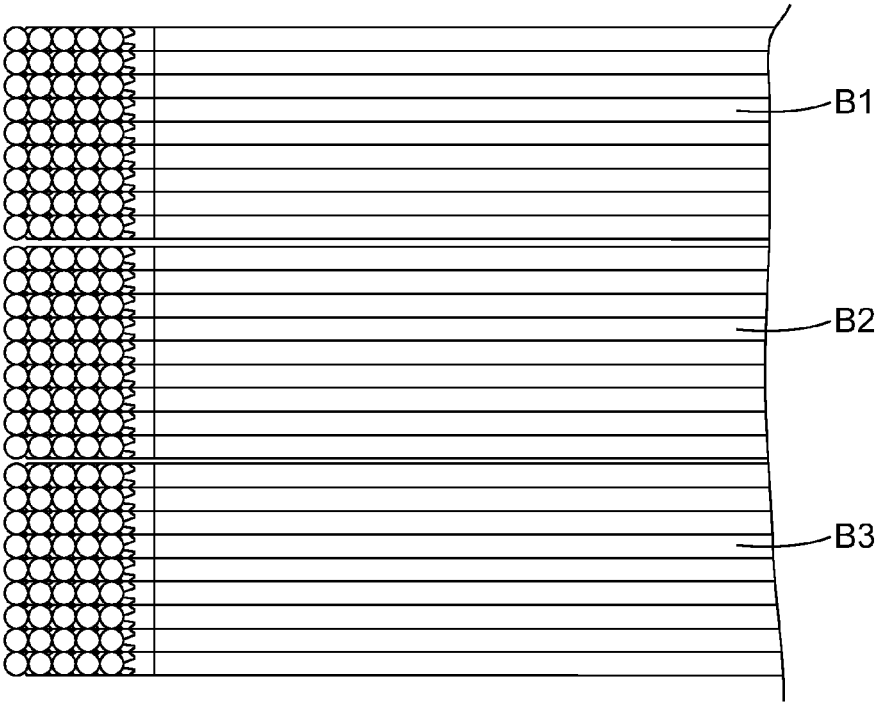
FIG. 5 shows a second example of cross-section of an air core reactor of the invention.
Figure 6:
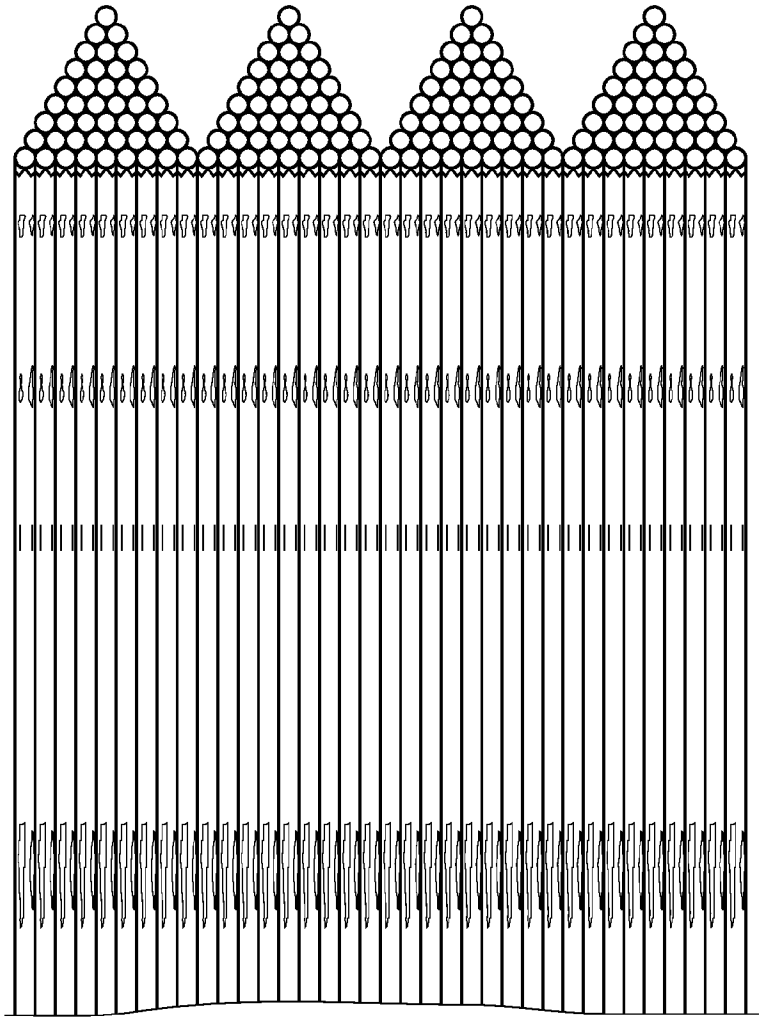
FIG. 6 shows a third example of cross-section of an air core reactor of the invention.

The FIG. 3 illustrates an example of the way the wire conductor is wound to form two successive bundles Bi, Bj. The first bundle Bi is made by winding the wire eleven times around an axis so as to form a first layer of conductor in the direction of the axis, then by winding the wire ten times around the axis upon the first layer so as to form a second layer of conductor, and so on until a fifth layer of conductor made by winding the wire seven times around the axis upon a fourth layer. When the first bundle has been achieved, the second bundle Bj is made in the same way than the first bundle Bi from a first layer to a fifth layer. As an example, each bundle has a trapezoidal cross-section (see FIG. 4). However, other forms of cross-section are concerned by the invention as, for example, a rectangular form (see FIG. 5) or a triangular form (see FIG. 6).

More generally, as it can be seen on FIG. 3, the wire conductor is wound on different levels to form a first bundle of conductor from a bottom level to an upper level and, when the upper level of the first bundle is reached, the wire conductor is taken back to the bottom level to form a second bundle of conductor next to the first bundle, and so on. A first terminal of the wire conductor is connected to one of the two cross-arms while the other terminal of the wire conductor is connected to the second cross-arm.

Figure 7:
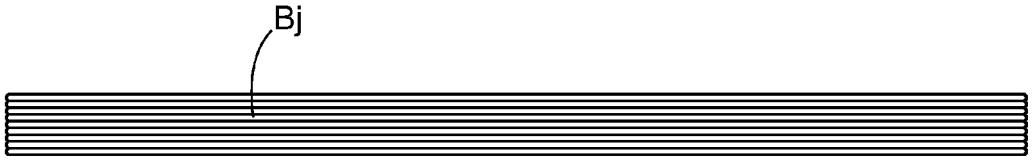
FIGS. 7-9 show examples of side view of bundles of conductor according to the invention.
Figure 8:
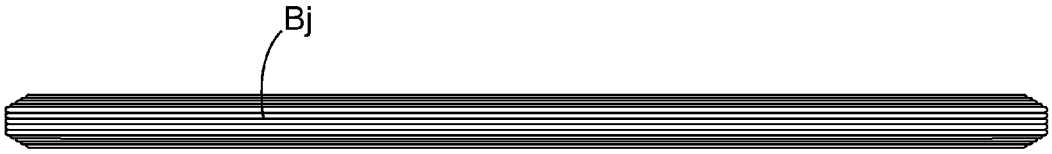
Figure 9:
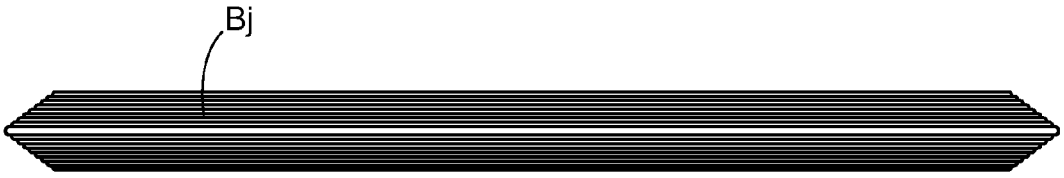

According to a second embodiment of the invention, each bundle of conductor is made separately and the different bundles are series-connected afterwards by means of electrical connections. The FIGS. 7-9 show side views of elementary bundles of conductor made separately. The FIG. 7 corresponds to a rectangular cross-section. The FIG. 8 corresponds to a trapezoidal cross section. The FIG. 9 corresponds to a triangular cross section.

Whatever is the embodiment, the air core reactor of the invention joins the benefits of air-core reactor technology with a very significant reduction in dimensions in comparison with the prior art. For example, a 800Ω/15 A reactor can be built with very reduced weight and an external diameter of 1.28 m, which is far lower than the typical dimensions of air-core reactors of the prior art.

The table below shows the comparison among three solutions:

(1) prior art iron core oil-filled reactor, (2) prior art air core reactor, (3) air core reactor according to the invention.

| Reactor | DIMENSIONS (m) | Weight (kg) |
|---|---|---|
| (1) Iron-core oil-filled reactor | 2.88 (W) × 3.20 (H) | 7200 |
| (2) Prior art air-core reactor | 3.00 (D) × 2.93 (H) | 609 |
| (3) Air core reactor of the invention | 1.28 (D) × 2.00 (H) | 381 |

With W for Width, H for Height and D for Diameter.

More generally, the air core reactor of the invention presents better characteristics in all points, when compared to all other available present solutions in the market.

A main advantage of the invention is to provide a high impedance air core reactor. It is therefore possible to achieve very high impedance air core reactors (as high as 10 kΩ for example), thus replacing oil-filled reactors with all benefits of the air core reactor technology, i.e. much lower cost, weight and dimensions, leakage and maintenance free, robustness and simplicity of mounting and installation.

The invention claimed is:

1. An air core reactor comprising a coil connected between a first terminal and a second terminal, the coil being made of at least two bundles of conductor connected in series along an axis between the first terminal and the second terminal, each bundle of conductor being made of a wire wound around said axis so as to form a multi-layer winding having a cross-section made of N winding layers in a direction perpendicular to the axis, from a winding layer of rank 1 which is the closest to the axis to a winding layer of rank N which is the furthest from the axis, for each bundle of conductor, each winding layer in the direction perpendicular to the axis comprising several windings in the direction of the axis, the number of windings in the direction of the axis of the winding layer of rank j in the direction perpendicular to the axis, j being taken between 2 to N, being equal or less than the number of windings in the direction of the axis of the winding layer of rank j−1 in the direction perpendicular to the axis, wherein all the bundles of conductor are made with a same wire in such a way that the air core reactor comprises only one wire, and wherein, for all the bundles of conductor of the air core reactor, the link between adjoining bundles of conductor being made by said same wire passing from the winding layer of rank N of a bundle of conductor to the winding layer of rank 1 of the adjoining bundle of conductor.

2. The air core reactor according to claim 1, wherein a cross section of each bundle of conductor is in a trapezoidal form.

3. The air core reactor according to claim 1, wherein a cross section of each bundle of conductor is in a rectangular form.

4. The air core reactor according to claim 1, wherein a cross section of each bundle of conductor is in a square form.

5. The air core reactor according to claim 1, wherein a cross section of each bundle of conductor is in a triangular form.

6. The air core reactor according to claim 1, wherein the wire conductor is encapsulated in an encapsulation pack made of fiberglass.

7. Process of manufacturing an air core reactor comprising a coil connected between a first terminal and a second terminal, characterized in that it comprises at least two steps of winding continuously a same wire around an axis, each step of winding said wire forming a multi-layer winding having a cross-section made of N winding layers in a direction perpendicular to the axis, from a winding layer of rank 1 which is the closest to the axis to a winding layer of rank N which is the furthest from the axis, for each bundle of conductor, each winding layer in the direction perpendicular to the axis comprising several windings in the direction of the axis, the number of windings in the direction of the axis of the winding layer of rank j in the direction perpendicular to the axis, j being taken between 2 to N, being equal or less than the number of windings in the direction of the axis of the winding layer of rank j−1 in the direction perpendicular to the axis, wherein, for all the bundles of conductor, said process further comprising linking adjoining bundles of conductor by passing said same wire from the winding layer of rank N of a bundle of conductor to the winding layer of rank 1 of the adjoining bundle of conductor in such a way that the air core reactor comprises only one wire.

8. An air core reactor comprising a coil connected between a first terminal and a second terminal, the coil being made of at least two bundles of conductor connected in series along an axis between the first terminal and the second terminal, each bundle of conductor being made of a wire wound around said axis so as to form a succession of N concentric winding layers around the axis, from a winding layer of rank 1 which is the closest to the axis to a winding layer of rank N which is the furthest from the axis, two successive winding layers being connected in series, for each bundle of conductor, each winding layer in the direction perpendicular to the axis comprising several windings in the direction of the axis, the number of windings in the direction of the axis of the winding layer of rank j in the direction perpendicular to the axis, j being taken between 2 to N, being equal or less than the number of windings in the direction of the axis of the winding layer of rank j−1 in the direction perpendicular to the axis, wherein all the bundles of conductor of the air core reactor are made with a same wire in such a way that the air core reactor comprises only one wire, wherein, for all the bundles of conductor, the link between two adjoining bundles of conductor being made by said same wire passing from the winding layer of rank N of a bundle of conductor to the winding layer of rank 1 of the adjoining bundle of conductor.

* * * * *